US006715776B2

(12) United States Patent
Lin

(10) Patent No.: US 6,715,776 B2
(45) Date of Patent: Apr. 6, 2004

(54) WHEEL SECURING STRUCTURE FOR A REMOTE-CONTROLLED MODEL CAR

(76) Inventor: Juei-Chuan Lin, 3F, No. 13, Alley 132, Lane 56, Sec. 3, Kanging Rd., Taipei (TW)

( * ) Notice: Subject to any disclaimer, the term of this patent is extended or adjusted under 35 U.S.C. 154(b) by 22 days.

(21) Appl. No.: 10/216,200

(22) Filed: Aug. 12, 2002

(65) Prior Publication Data

US 2004/0026885 A1 Feb. 12, 2004

(51) Int. Cl.[7] ..... B62D 7/18
(52) U.S. Cl. ..... 280/93.512; 446/468; 301/132
(58) Field of Search ..... 280/93.512, 137.503; 301/131, 132; 446/460, 468

(56) References Cited

U.S. PATENT DOCUMENTS 3,563,564 A * 2/1971 Bartkowiak ..... 280/93.512
3,749,415 A * 7/1973 Sampatacos ..... 280/124.136
4,722,540 A * 2/1988 Kozyra et al. ..... 280/124.136
6,557,872 B1 * 5/2003 Garrard ..... 280/86.751

* cited by examiner

*Primary Examiner*—Paul N. Dickson
*Assistant Examiner*—George D Spisich
(74) *Attorney, Agent, or Firm*—Birch, Stewart, Kolasch & Birch, LLP

(57) ABSTRACT

An improved wheel securing structure for a remote-controlled model car includes a steering seat and a U-shaped securing frame. The steering seat is disposed in the U-shaped structure of the securing frame and is connected thereto by means of screw and bushing. The invention is characterized in that the steering seat has a slightly protruding hole seat provided at each of upper and lower opposing ends of the housing thereof. The hole seat has an edge-cut positioning groove provided in inner side surfaces of through hole respectively. Two screws have head portions respectively formed with flat edges. The screws extend from the inner side of the steering seat through outer end of the through hole, with the flat edges embedded in the positioning groove. The other end of the screw is provided with a nut to secure the assembly tightly.

2 Claims, 5 Drawing Sheets

WHEEL SECURING STRUCTURE FOR A REMOTE-CONTROLLED MODEL CAR

BACKGROUND OF THE INVENTION (a) Field of the Invention

The invention relates to an improved wheel securing structure for a remote-controlled model car, more particularly to a wheel securing structure that is not likely to loosen, mainly having screws extending through in an ingenious manner, and cooperating with a combination of other relevant components to prevent slippage thereof due to vibration, thereby reducing excessive screw tapping steps in the prior art and improving the manufacturing process.

(b) Description of the Prior Art

For remote-controlled model cars, the wheel securing structure thereof is very important. This is because, if the structure design is not good, the locking screws may become loosened when the model car moves up and down slopes, bounce, or is subjected to prolonged operation. If the screws slip during operation of the model car, the wheels will slant, and the game or contest will have to be stopped. A conventional wheel steering structure for a model car is shown in FIGS. 4 and 5, and is mainly provided with a steering seat 60 accommodating a universal connector therein, and having a linkage rod 61 extending therefrom. Upper and lower ends of the housing thereof are respectively provided with screw holes 62. There is further provided a substantially U-shaped securing frame 70 with a central plate provided with a middle hole 71, and upper and lower plates respectively provided with side holes 72. The steering seat 60 is disposed in the center of the U-shaped structure of the securing frame 70, with the linkage rod 61 thereof passing through middle hole 71 of securing frame 70 to be connected to other structural elements (not discussed in detail herein). Screw holes 62 of steering seat 60 align with side holes 72 of securing frame 70. A respective screw 80 passes through a respective bushing 90 and then through side hole 72 to be locked in screw hole 62 of the housing of steering seat 60. Described above is the conventional structure.

However, when the above-described conventional structure is in actual use, vibration is inevitable, and the screw 80 locks only the screw hole 62 of steering seat 60. Therefore, the screw 80 easily becomes loosened. Once the rear end of screw 80 disengages from the screw hole 62, then steering seat 60, securing frame 70, two screws 80 and two bushings 90 will become loosened and slant, or even scatter around, without any warning. Besides, with the components scattered around, it is very troublesome to reassemble. This is a common problem of the conventional structure, and is what the industry wants to eliminate.

In addition, providing screw holes 62 on steering seat 60 is inconvenient during processing. If there is any damage, all the materials cannot be used. Therefore, the faulty product rate cannot be effectively reduced. This is another disadvantage of the conventional structure.

SUMMARY OF THE INVENTION

Therefore, the main object of the invention is to provide a wheel securing structure that does not easily become disengaged due to vibration, the concrete structure of which can be achieved in this manner:

A steering seat is provided. The center thereof is provided with a receiving recess for mounting of universal connector, linkage rod and a number of locking elements therein. There is further provided a substantially U-shaped securing frame with a central plate provided with a middle hole, and upper and lower plates provided respectively with side holes. The steering seat is disposed in the center of the U-shaped structure of securing frame, with linkage rod passing through middle hole of securing frame to be connected to other structural elements, and cooperating with a screw and bushing to permit steering seat to be mounted on securing seat. Upper and lower opposite ends of receiving recess of the housing of steering seat are respectively provided with slightly protruding hole seats, which are centrally provided with through holes. Inner side surface of through hole of the hole seat is provided with a respective positioning groove having cut edges. Two screws are respectively formed with flat edges at head portions thereof, and can extend from inner side of steering seat through outer end of through hole, the screw having the flat edges thereof embedded in positioning groove at the same time. The other end of the screw passes through side hole of securing frame, and is fitted with a bushing as bearing, and has a nut fitted thereon to secure the assembly tightly. At the same time, there is no need for drilling excessive screw holes. Such is the feature of the invention.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
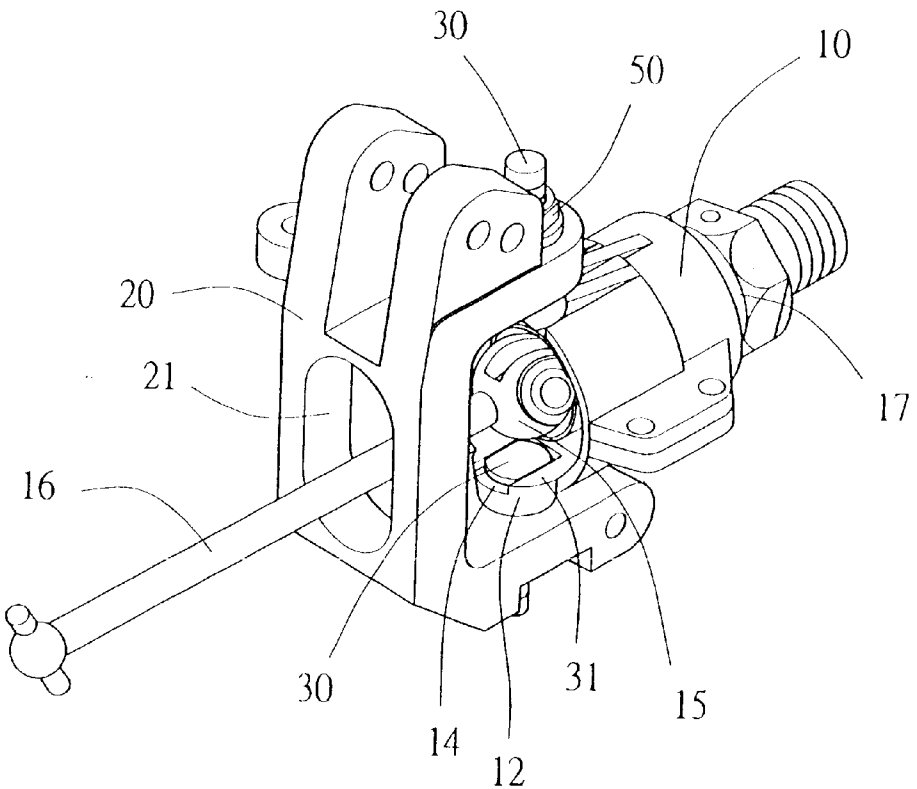
FIG. 1 is an assembled view of the invention.
Figure 2:
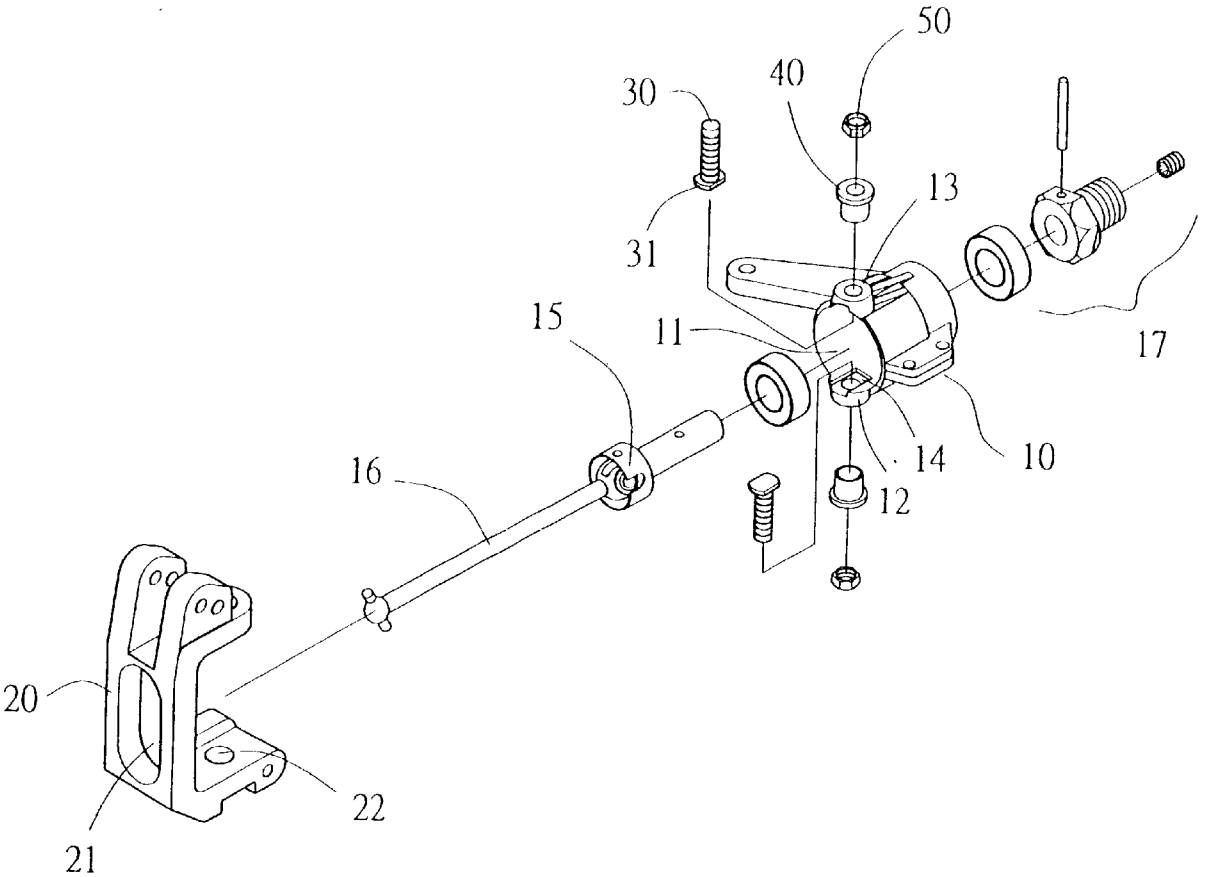
FIG. 2 is an exploded view of the structure of the invention.
Figure 3:
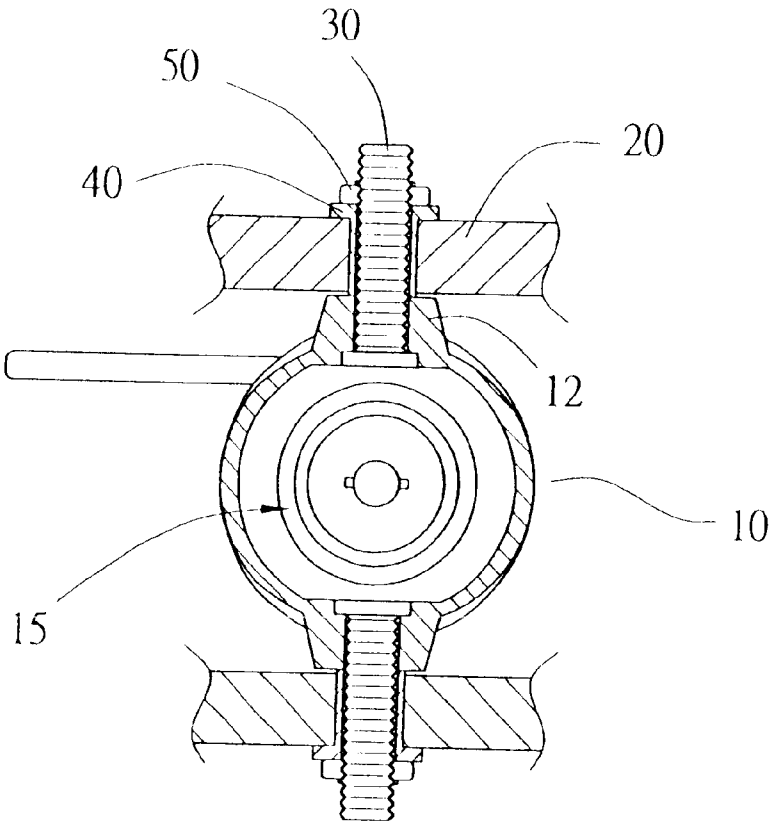
FIG. 3 is a sectional structural view of the invention.
Figure 4:
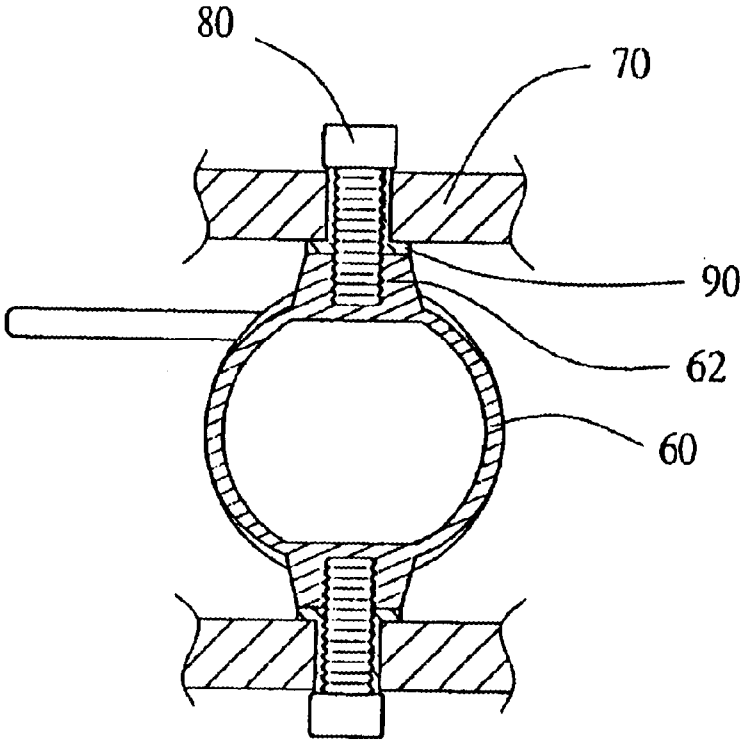
Fig 4 PRIOR ART
FIG. 4 is a sectional view of a conventional structure.
Figure 5:
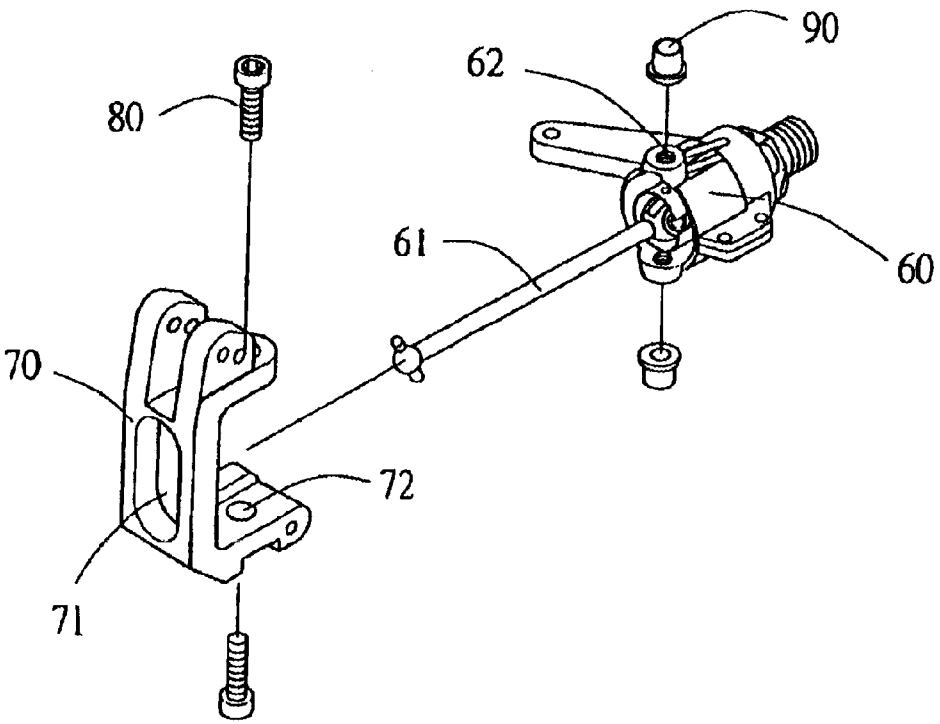
Fig 5 PRIOR ART
FIG. 5 is an exploded view of the conventional structure.

With reference to FIGS. 1 to 3, the invention includes a steering seat 10, which is centrally provided with a receiving recess 11 for mounting of universal connector 15, linkage rod 16 and a number of locking elements 17 therein. There is further provided a substantially U-shaped securing frame 20, a middle plate thereof being provided with a middle hole 21, upper and lower plates thereof being respectively provided with side holes 22. The steering seat 10 can be disposed in the center of the U-shaped structure of the securing frame 20, with the linkage rod 16 thereof passing through the middle hole 21 of the securing frame 20 to be connected to the other structural elements. By means of a screw 30 and bushing 40, steering seat 10 can be mounted on securing frame 20. The invention is characterized in that: Steering seat 10 has a slightly protruding hole seat 12 provided at each of upper and lower opposing ends of receiving recess 11 of the housing thereof. The center of the hole seat 12 is provided with a through hole 13. The hole seat 12 has a circular edge-cut positioning groove 14 provided in inner side surfaces of through hole 13 respectively, and the positioning groove 14 may have a hexagonal shape or other polygonal shapes depending on the shape of the screw head, which should be within the scope of the invention, as herein noted.

Two screws 30 have head portions respectively formed with flat edges 31 so as to be able to extend outwardly from the inner side of the steering seat 10 through through hole

13, with flat edges 31 of the screw 30 embedded in the positioning groove 14 at the same time to prevent rotation thereof. After the other end of the screw 30 extends through side hole 12 of securing frame 20, a bushing 40 is fitted as a bearing, and a nut 50 is disposed thereon to secure the assembly tightly.

The invention has the following advantages in use:

1. Screw 30 in the invention extends from the inside to the outside, and the flat edges 31 thereof are insertably fixed within securing groove 14 so as to be prevented from rotation. Therefore, screw 30 will not rotate due to vibration, i.e. will not become loosened. This is the major advantage of the invention.
2. Since universal connector 15 and other components are at the rear side of flat edges 31 of screw 30 of the invention, even if nut 50 is loosened, the screw 30 still cannot slip from the inside, and the car body can be temporarily prevented from falling apart. This is another advantage of the invention.
3. During manufacture, since the through hole of the steering seat and the side holes of the securing frame do not require tapping screw holes, the manufacturing process is more convenient, and faulty product rate can be reduced. This is a further advantage of the invention.

What is claimed is:

1. An improved wheel securing structure for a remote-controlled model car, comprising a steering seat, which is centrally provided with a receiving recess for mounting of a universal connector, a linkage rod and a number of locking elements therein, a substantially U-shaped securing frame having a central plate provided with a middle hole, and upper and lower plates respectively provided with side holes, said steering seat being disposed in the center of the substantially U-shaped structure of said securing seat, with said linkage rod passing through said middle hole of said securing frame to be connected to other structural elements, and cooperating with a screw and bushing to enable said steering seat to be assembled on said securing frame, wherein:

said steering seat having a slightly protruding hole seat provided at each of upper and lower opposing ends of said receiving recess of the housing thereof, the centers of said hole seats being provided with through holes, said hole seats each having an edge-cut positioning groove provided in inner side surfaces of said through holes respectively;

two screws having head portions respectively formed with flat edges so as to respectively extend from the inner side of said steering seat through the outer end of said through holes, with said flat edges of said two screws extending respectively through said side holes of said securing frame, a bushing being further fitted as a bearing, and a nut being further disposed on said bushing to secure the assembly tightly.

2. The improved wheel securing structure for a remote-controlled model car as claimed in claim 1, wherein said positioning grooves have a hexagonal shape or other polygonal shapes depending on the shape of screw head.

* * * * *